US005340615A

United States Patent [19]

Browning

[11] Patent Number: 5,340,615

[45] Date of Patent: Aug. 23, 1994

[54] METHOD TO PRODUCE NON-STRESSED FLAME SPRAY COATING AND BODIES

[76] Inventor: James A. Browning, c/o DRACO, P.O. Box 6, Hanover, N.H. 03755

[21] Appl. No.: 69,412

[22] Filed: Jun. 1, 1993

[51] Int. Cl.[5] ..... B05D 1/08; B05D 1/10

[52] U.S. Cl. ..... 427/446; 427/426

[58] Field of Search ..... 427/446, 426; 239/79, 239/80, 82, 83, 85

[56] References Cited

U.S. PATENT DOCUMENTS 2,861,900 11/1958 Smith et al. ..... 427/446
4,386,112 5/1983 Eaton et al. ..... 427/446

FOREIGN PATENT DOCUMENTS 723842 2/1955 United Kingdom .

*Primary Examiner*—Terry J. Owens
*Assistant Examiner*—Katherine A. Bareford
*Attorney, Agent, or Firm*—Sughrue, Mion, Zinn, Macpeak & Seas

[57] ABSTRACT

A high temperature flame spray or plasma effects thermal spray impact of molten materials against a target area of a surface to be built up, which molten particles, when cooled, are in tension, and an impact fusion internal burner device producing a supersonic jet stream impacts thermal spray heated solid particles against the surface in the target area such that the high velocity of the individual solid particles are impact fused, causing compressive stresses to be set up in the fused solid particles. The individual particle tensile and compressive stresses cancel one another to form an overall essentially stress-free coating. The flame spray molten particles and the flame spray heated solid particles may impact the surface concurrently at a same impact point. Alternatively, thin separate layers of the molten particles and the heated solid particles are deposited on the surface to be built up and superimposed on each other such that the tensile and compressive stresses of the particles of respective superimposed layers cancel each other out.

3 Claims, 1 Drawing Sheet

METHOD TO PRODUCE NON-STRESSED FLAME SPRAY COATING AND BODIES

BACKGROUND OF THE INVENTION

Classically, thermal spraying has used high temperature flames or plasmas to melt and project metal and other particles against a surface to be coated. The molten particles flatten upon impact against the workpiece, adhere to the workpiece, and then contract due to cooling. The final cooled coating is characterized by tensile stresses as the individual "splats" are restrained by the workpiece and adjacent adhering particles from reaching a state of zero stress. Such coatings cannot be built-up to appreciable thicknesses -with most coatings limited to under 1/32-inch.

More recently, a new thermal spraying technique has been introduced. It speeds heated solid particles to such great speed that upon impact they fuse to form a dense coating. The applicant has found that such coatings are under compressions—just the opposite of coatings produced by impact of molten particles. This impact-fusion method allows much thicker coatings to be produced. Yet, a point is reached where the overall compressive faces produced in the coating can lead to coating cracking or separation from the workpiece surface.

Although compressive stressing of thermal spray coatings is to be preferred to tensile stressing, the optimum coating (for most cases) would be zero stress levels.

SUMMARY OF THE INVENTION

The prescribed invention depends on a dual-spraying technique to produce essentially stress-free coatings. Two, or more, individual spray systems are utilized. A high temperature system (either flame spray or plasma) impacts a certain proportion of the total coating particles against the workpiece surface within a target area or impact point 30 concurrently with a second extreme velocity device accelerating the remaining particle flow in its solid state to create fusion bonding. By selecting the proper ratio between tensile causing build-up and compression causing build-up, a net build-up coating which is essentially zero-stress condition can be obtained.

DESCRIPTION OF THE PREFERRED EMBODIMENTS

Figure 1:
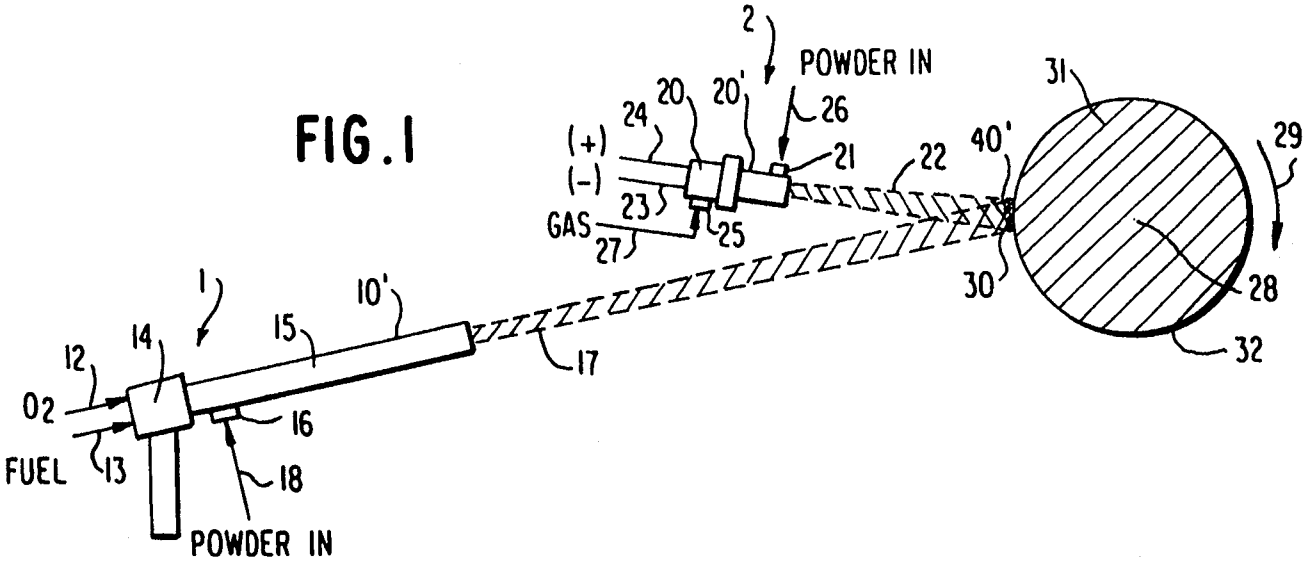
FIG. 1 is a schematic elevational view of an equipment setup for practicing a thermal spray method forming one embodiment of this invention.

Referring to FIG. 1, an impact fusion internal burner device 10' operating on the "rocket" flame principle produces a supersonic jet stream 17 and is provided with oxygen at 12 and fuel at 13 as reactants which burn within body 14 in a combustion chamber (not shown) internally of body 14. The hot gases produced at high pressure by this combustion expand through a supersonic nozzle (not shown) to form a supersonic stream flow through an extended length duct 15. Powdered material 18 is introduced into the supersonic stream at point 16 within duct 15, along the expanded gas, where the temperature of the gas is sufficiently reduced by said expansion to preclude heating the powdered material particles to this melting point. The extended length duct 15 allows sufficient time for the heated particles to accelerate to velocities capable of producing heat on impact against the periphery 32 of a cylindrical workpiece 31 to fuse the particles to form a coating 40'. This coating, if the burner 10' of the first spray system 1 were used alone, is stressed compressively.

A second spray system 2 utilizes a plasma spray torch 20' operating under an electric arc powered by leads 23 and 24 from a DC power source. Powder 26 is injected into an exiting plasma gas at port 21. Gas 27, such as nitrogen, passes into the arc from entry port 25. The particles of powder in plasma jet stream 22 are rendered molten. Upon impact against the periphery 32 of the workpiece 31 at the target area 40' the molten particles cool to solidification where they become stressed in tension.

The workpiece 31 may be rotated slowly about its axis as indicated by arrow 29. The final coating is comprised of two types of impacted particles. As seen better in FIG. 2, the plasma-heated molten particles of system 2 flatten into "splats" 41. Each such particle will be in-tension. The impact fused particles 42 are more granular in cross-sectional shape. They are stressed in compression. Where particles 41 and 42 are in contact, the stresses in each are reduced. That is, adherence of a compressively-stressed particle to an adjacent particle in-tension causes the stress level of each to be reduced somewhat. Where two "splats" overlap, the tensile stresses are amplified somewhat. But, if proper mass flows of each type of powder constituent are used, the overall coating internal stress can be rendered essentially zero.

Figure 2:
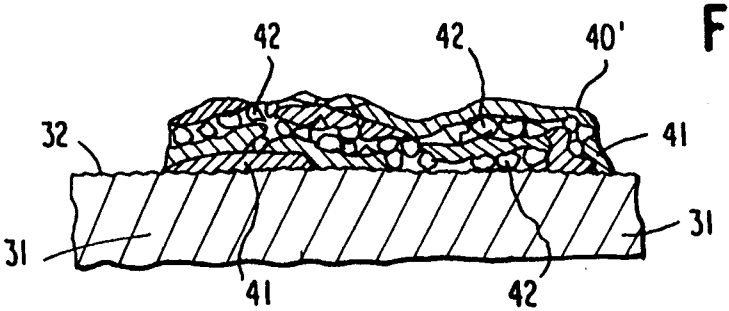
FIG. 2 is an idealized cross-sectional view of a small portion of a typical coating produced by the method of this invention effected in accordance with the setup of FIG. 1.

In FIG. 2, a small portion of the peripheral surface of workpiece 31 (a shaft) is shown as though it were a photomicrograph. Surface 32 has been roughened to provide better adhesion of the particles to that surface. The two types of particle impaction are so intimately grouped together that, although several "splats" may be in contact, overall tensile stresses within the coating 40' are never sufficiently built up to values which lead to failure of the coating.

It is important in the practice of the method of this invention that the patterns of the two impacting particle systems 1, 2 impinge concurrently at the same target area impact point 30 on workpiece shaft 31, shown to be rotating at 29.

A alternate method forming a second embodiment of this invention, is to place a thin coating on layer on the workpiece or substrate by one technique, followed by a second layer produced by the second technique, and continuing to alternate the layers of differing stress sign to build up the total coating thickness. The layers must be kept sufficiently thin that overall stress levels leading to failure are not produced in any single layer.

Although thermal spraying to build up coatings on workpiece surfaces has been discussed in the preferred embodiments to clarify the methods of the invention, it should be clear that the same method apply to building structural or other shaped solids such as bearings, shafts, and other shapes common to both the castings and powder metallurgy industries.

What is claimed is:

1. A method for producing stress-free thermal sprayed coatings or solid bodies, comprising the steps of:

thermal spray impacting molten particles against a target area of a surface to be built up, and cooling said molten particles after impact, such that said particles, when cooled, are in-tension, and thermal spray impact fusing heated solid particles at supersonic velocity against said surface at said target area whereby individual solid particles are impact fused to said built-up surface at said target area, and cooling said impact fused particles, thereby causing compressive stress to be set up in the impact fused particles; whereby said individual particle tensile and compressive stresses cancel one another to form an overall essentially stress-free coating.

2. The method as claimed in claim 1, wherein said molten particles and said heated solid particles concurrently impact said surface at a same impact point.

3. The method as claimed in claim 1, wherein said molten particles and said heated solid particles are deposited as separate layers alternately on said surface to be built up and superimposed on each other, whereby said tensile and compressive stresses of said particles of respective superimposed layers cancel each other out and wherein said method further comprises maintaining said layers sufficiently thin that overall stress levels leading to failure are not produced in any single layer.

* * * * *